US009976733B1

(12) United States Patent
Lin

(10) Patent No.: US 9,976,733 B1
(45) Date of Patent: May 22, 2018

(54) LIGHTING DEVICE

(71) Applicant: Pin-Chih Lin, Taipei (TW)

(72) Inventor: Pin-Chih Lin, Taipei (TW)

( * ) Notice: Subject to any disclaimer, the term of this patent is extended or adjusted under 35 U.S.C. 154(b) by 0 days. days.

(21) Appl. No.: 15/591,809

(22) Filed: May 10, 2017

(51) Int. Cl.

| | |
|---|---|
| ***F21V 1/00*** | (2006.01) |
| ***F21V 23/04*** | (2006.01) |
| ***F21V 3/00*** | (2015.01) |
| ***F21V 11/00*** | (2015.01) |
| ***F21V 23/00*** | (2015.01) |

(52) U.S. Cl.
CPC ..... *F21V 23/0464* (2013.01); *F21V 3/00* (2013.01); *F21V 11/00* (2013.01); *F21V 23/003* (2013.01)

(58) Field of Classification Search
USPC ..... 362/235, 249.01, 249.02
See application file for complete search history.

(56) References Cited

U.S. PATENT DOCUMENTS 4,918,536 A * 4/1990 Sakakibara ..... G03F 7/0022 347/230

* cited by examiner

*Primary Examiner* — Vip Patel
(74) *Attorney, Agent, or Firm* — Hershkovitz & Associates, PLLC; Abe Hershkovitz

(57) ABSTRACT

A lighting device includes a substrate, a control circuit, multiple lighting elements and an opaque division plate. The control circuit, the lighting elements and the division plate are mounted on the substrate. The control circuit has a sensor. The lighting elements are electrically connected to the control circuit. The division plate is located between the control circuit and the lighting elements. Given the opaque division plate installed between the lighting elements and the control circuit, light emitted from the lighting elements fails to penetrate through the division plate and is thus not sensed by the sensor on the control circuit opposite to the lighting elements. Accordingly, when detecting a dark environmental luminance, the control circuit activates the lighting elements, and after the lighting elements are activated, light emitted from the lighting elements won't cast on the sensor to affect correct determination of the control circuit.

28 Claims, 5 Drawing Sheets

LIGHTING DEVICE

BACKGROUND OF THE INVENTION

1. Field of the Invention

The present invention relates to a lighting device and, more particularly, to a lighting device with a sensor activating or deactivating the lighting device according to a light-sensing condition insusceptible to light emitted from the lighting device itself.

2. Description of the Related Art

Regular lighting devices, such as light bulbs, light tubes and the like, are usually equipped with a sensor and a controller per lighting device for the controller to activate or deactivate the lighting device by using the sensor to detect environmental luminance. For example, when the sensor detects weak light and the controller determines that the environmental luminance reaches a low level of brightness, the controller then sends out a signal to activate the lighting device to emit light, and when the sensor detects bright light and the controller determines that the environmental luminance reaches a high level of brightness, the controller sends out a signal to deactivate the lighting device. To take an identical environment both sensed by the sensor and emitting light from the lighting device thereto, the sensor is directly installed inside the lighting device.

However, conventional lighting devices with sensors have their sensors in the proximity of lighting elements, such that the lighting elements directly cast light on the sensors. In other words, when the environment is dark, the sensor and the controller activate the lighting elements to emit light. Meanwhile, the lighting elements in turn cast light on the sensor, rendering a false luminance that the controller determines that the environmental luminance is bright enough and further deactivates the lighting elements. As a consequence, the conventional lighting devices with sensors fail to provide adequate lighting in response to environmental luminance.

SUMMARY OF THE INVENTION

An objective of the present invention is to provide a lighting device with a sensor capable of correctly sensing environmental luminance.

To achieve the foregoing objective, the lighting device includes a substrate, a control circuit, multiple lighting elements and a division plate.

The control circuit is mounted on the substrate and has a sensor.

The multiple lighting elements are mounted on the substrate and are electrically connected to the control circuit.

The division plate is opaque, is mounted on the substrate, and is located between the control circuit and the multiple lighting elements.

By virtue of the opaque division plate installed between the multiple lighting elements and the control circuit, light emitted from the multiple lighting elements won't penetrate the division plate to affect the sensing of the sensor over the other side of the division plate. Accordingly, what the light sensed by the sensor on the control circuit is purely natural light from the environment. When sensing a dark environmental luminance, the control circuit then activates the multiple lighting elements to emit light. After the multiple lighting elements are activated, light emitted from the multiple lighting elements won't cast on the sensor to result in incorrect determination of the control circuit.

Other objectives, advantages and novel features of the invention will become more apparent from the following detailed description when taken in conjunction with the accompanying drawings.

DETAILED DESCRIPTION OF THE INVENTION

Figure 1:
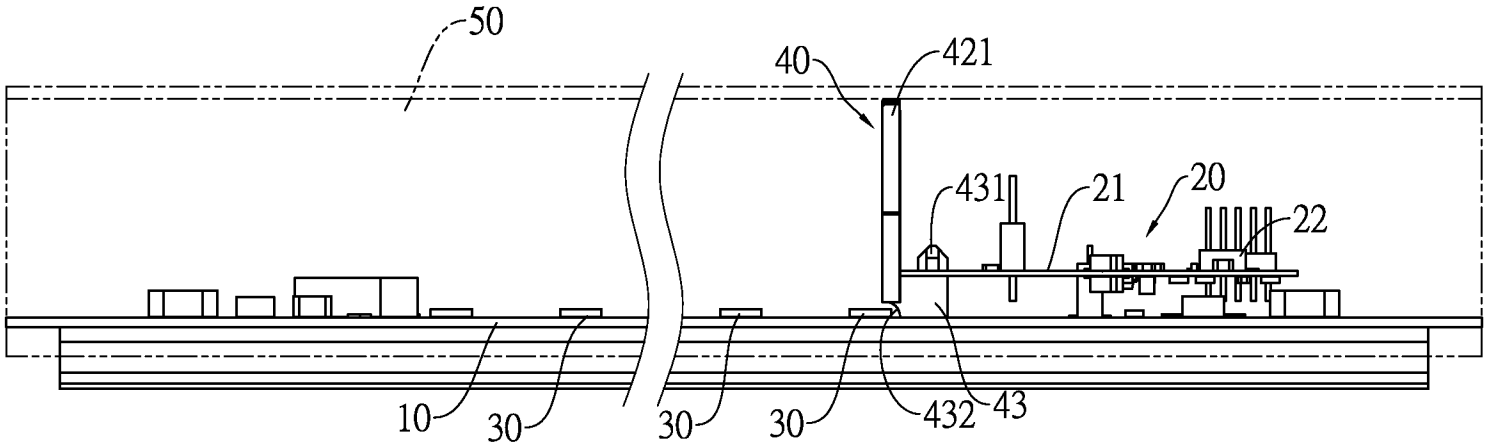
FIG. 1 is a side view of a lighting device in accordance with the present invention.
Figure 2:
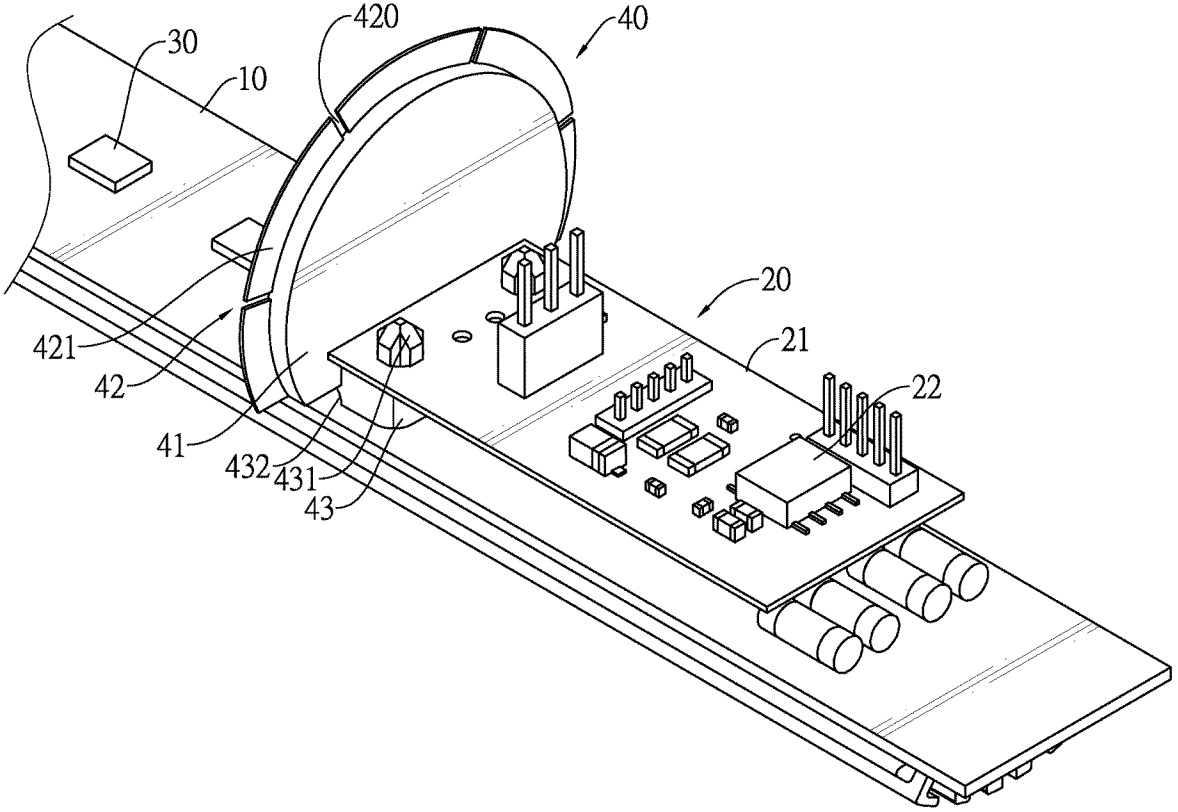
FIG. 2 is a partial perspective view of the lighting device in FIG. 1.

With reference to FIGS. 1 and 2, a lighting device in accordance with the present invention includes a substrate 10, a control circuit 20, multiple lighting elements 30, a division plate 40 and a transparent cover 50. The control circuit 20, the multiple lighting elements 30, the division plate 40 and the transparent cover 50 are mounted on the substrate 10. The transparent cover 50 covers the control circuit 20, the multiple lighting elements 30 and the division plate 40 therein.

Figure 3:
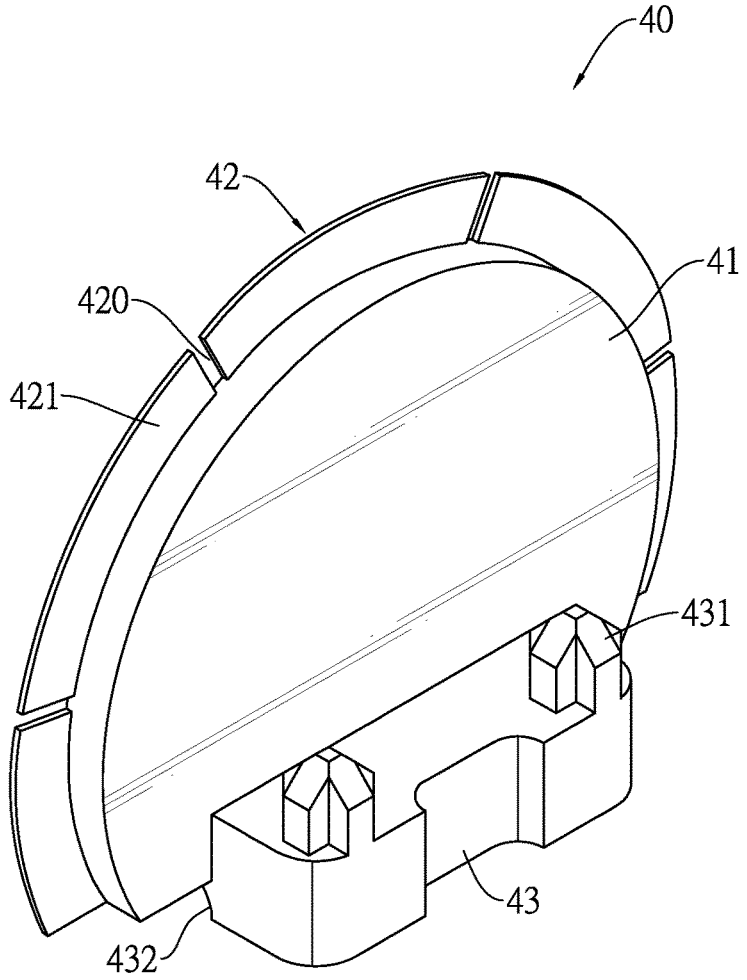
FIG. 3 is an enlarged perspective view of a division plate of the lighting device in FIG. 2.
Figure 4:
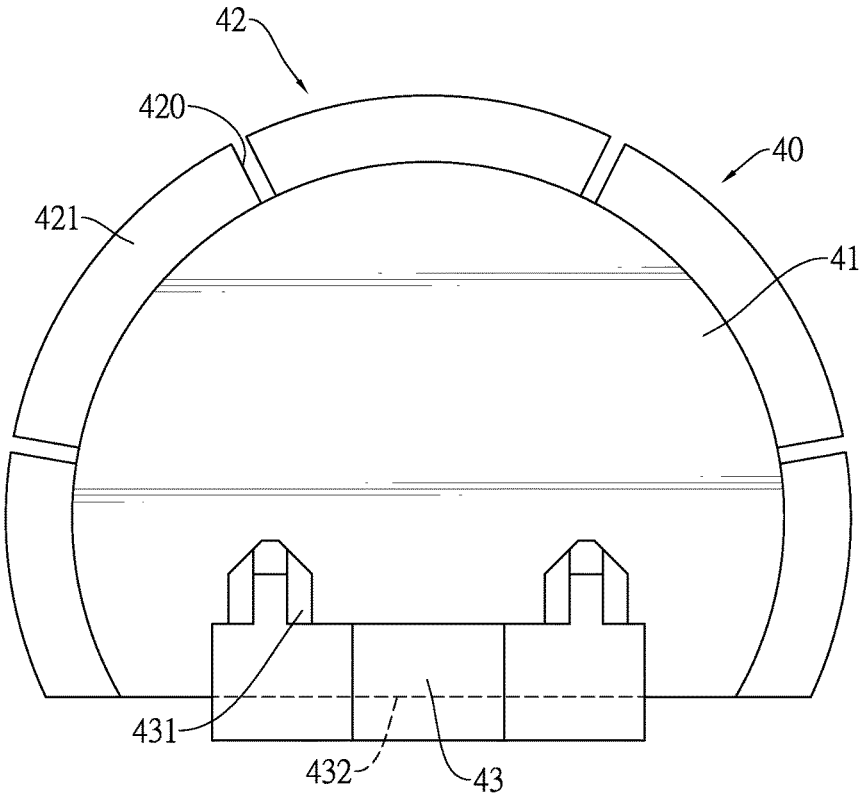
FIG. 4 is a front view of the division plate in FIG. 3.
Figure 5:
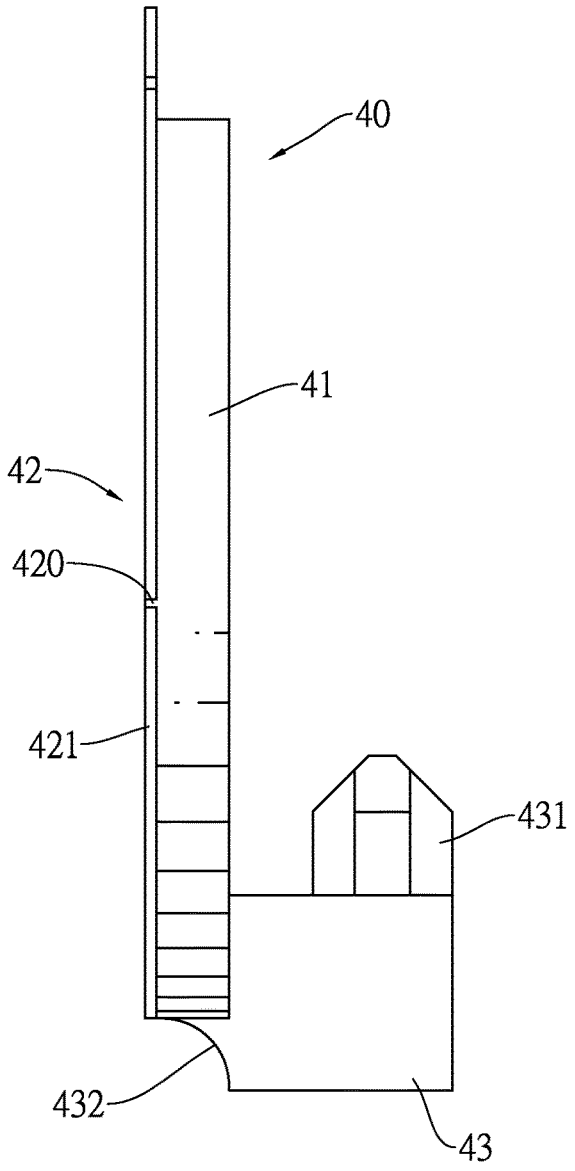
FIG. 5 is a side view of the division plate in FIG. 3.

With reference to FIGS. 3 to 5, the division plate 40 is mounted between the control circuit 20 and the multiple lighting elements 30 and has a rigid portion 41, a resilient portion 42 and a base 43. The division plate 40 is made of an opaque material. The resilient portion 42 is mounted on an upper edge portion of the rigid portion 41, and has multiple slits 420 inwardly formed in the resilient portion 42 and directed to and intersected at a center of the division plate 40.

With further reference to FIG. 1, when the transparent cover 50 is mounted on the substrate 10 to cover the division plate 40 therein, the resilient portion 42 is bent to contact an inner surface of the transparent cover 50. The resilient portion 42 has multiple ears 421 mounted on the upper edge portion of the rigid portion 41 and separated by the multiple slits 420. When contacting the inner surface of the transparent cover 50 and bent, each ear 421 is attached to the inner surface of the transparent cover 50 without light leakage occurring between gaps formed between the division plate 40 and the transparent cover 50.

The base 43 is mounted on a lower edge portion of the rigid portion 41 and protrudes downwards to abut against the substrate 10. In the present embodiment, the base 43 has at least one raised portion 431 and an indentation 432. The at least one raised portion 431 is formed on and protrudes upwards from a top of the base 43. The indentation 432 is formed in an edge portion of a bottom of the base 43 with a concave surface of the indentation 432 facing the multiple lighting elements 30.

With further reference to FIGS. 1 and 2, the control circuit 20 has a circuit board 21 and a sensor 22. The circuit board 21 is mounted on the substrate 10 with one end thereof mounted on the base 43. In the present embodiment, the circuit board 21 is mounted through the at least one raised portion 431 of the base 43. The sensor 22 is mounted on the circuit board 21 and is electrically connected to the circuit board 21.

The multiple lighting elements 30 are electrically connected to the control circuit 20. In the present embodiment, one of the multiple lighting elements 30 is partially received in the indentation 432 of the base 43. Each lighting element 30 may be a light-emitting diode (LED) or a light bulb.

In sum, the opaque division plate 40 installed between the multiple lighting elements 30 and the control circuit 20 blocks light emitted from the multiple lighting elements 30 and prevents the sensor 22 on the control circuit 20 from sensing the light emitted from the multiple lighting elements 30. What the light sensed by the sensor 22 is purely the natural light from the environment. Therefore, when sensing a dark environmental luminance, the control circuit 20 then activates the multiple lighting elements 30 to emit light. After the multiple lighting elements 30 are activated, light emitted from the multiple lighting elements won't cast on the sensor 22 to result in incorrect determination of the control circuit 20.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A lighting device comprising:

a substrate;

a control circuit mounted on the substrate and having a sensor;

multiple lighting elements mounted on the substrate and electrically connected to the control circuit; and a division plate being opaque, mounted on the substrate, and located between the control circuit and the multiple lighting elements.

2. The lighting device as claimed in claim 1, further comprising a transparent cover mounted on the substrate and covering the control circuit, the multiple lighting elements and the division plate therein.

3. The lighting device as claimed in claim 2, wherein the division plate has:

a rigid portion; and a resilient portion mounted on an upper edge portion of the rigid portion and contacting an inner surface of the transparent cover.

4. The lighting device as claimed in claim 3, wherein the resilient portion of the division plate has multiple slits inwardly formed in the resilient portion and directed to and intersected at a center of the division plate.

5. The lighting device as claimed in claim 1, wherein the division plate has a base mounted on the substrate;

the control circuit has a circuit board mounted on the substrate with one end of the circuit board mounted on the base; and the sensor is mounted on the circuit board.

6. The lighting device as claimed in claim 2, wherein the division plate has a base mounted on the substrate;

the control circuit has a circuit board mounted on the substrate with one end of the circuit board mounted on the base; and the sensor is mounted on the circuit board.

7. The lighting device as claimed in claim 3, wherein the division plate has a base mounted on the substrate;

the control circuit has a circuit board mounted on the substrate with one end of the circuit board mounted on the base; and the sensor is mounted on the circuit board.

8. The lighting device as claimed in claim 4, wherein the division plate has a base mounted on the substrate;

the control circuit has a circuit board mounted on the substrate with one end of the circuit board mounted on the base; and the sensor is mounted on the circuit board.

9. The lighting device as claimed in claim 5, wherein the base of the division plate has at least one raised portion, and the circuit board of the control circuit is mounted through the at least one raised portion.

10. The lighting device as claimed in claim 6, wherein the base of the division plate has at least one raised portion, and the circuit board of the control circuit is mounted through the at least one raised portion.

11. The lighting device as claimed in claim 7, wherein the base of the division plate has at least one raised portion, and the circuit board of the control circuit is mounted through the at least one raised portion.

12. The lighting device as claimed in claim 8, wherein the base of the division plate has at least one raised portion, and the circuit board of the control circuit is mounted through the at least one raised portion.

13. The lighting device as claimed in claim 8, wherein the base of the division plate protrudes downwards to abut against the substrate and has an indentation facing the multiple lighting elements.

14. The lighting device as claimed in claim 9, wherein the base of the division plate protrudes downwards to abut against the substrate and has an indentation facing the multiple lighting elements.

15. The lighting device as claimed in claim 10, wherein the base of the division plate protrudes downwards to abut against the substrate and has an indentation facing the multiple lighting elements.

16. The lighting device as claimed in claim 11, wherein the base of the division plate protrudes downwards to abut against the substrate and has an indentation facing the multiple lighting elements.

17. The lighting device as claimed in claim 12, wherein the base of the division plate protrudes downwards to abut against the substrate and has an indentation facing the multiple lighting elements.

18. The lighting device as claimed in claim 13, wherein the base of the division plate protrudes downwards to abut against the substrate and has an indentation facing the multiple lighting elements.

19. The lighting device as claimed in claim 14, wherein the base of the division plate protrudes downwards to abut against the substrate and has an indentation facing the multiple lighting elements.

20. The lighting device as claimed in claim 15, wherein the base of the division plate protrudes downwards to abut against the substrate and has an indentation facing the multiple lighting elements.

21. The lighting device as claimed in claim 13, wherein one of the multiple lighting elements is partially received in the indentation of the base.

22. The lighting device as claimed in claim 14, wherein one of the multiple lighting elements is partially received in the indentation of the base.

23. The lighting device as claimed in claim 15, wherein one of the multiple lighting elements is partially received in the indentation of the base.

24. The lighting device as claimed in claim 16, wherein one of the multiple lighting elements is partially received in the indentation of the base.

25. The lighting device as claimed in claim 17, wherein one of the multiple lighting elements is partially received in the indentation of the base.

26. The lighting device as claimed in claim 18, wherein one of the multiple lighting elements is partially received in the indentation of the base.

27. The lighting device as claimed in claim 19, wherein one of the multiple lighting elements is partially received in the indentation of the base.

28. The lighting device as claimed in claim 20, wherein one of the multiple lighting elements is partially received in the indentation of the base.

* * * * *